US007226362B1

(12) United States Patent
Schell et al.

(10) Patent No.: US 7,226,362 B1
(45) Date of Patent: Jun. 5, 2007

(54) GOLF CLUB HEAD INCLUDING ALIGNMENT DEVICE

(75) Inventors: Daniel Schell, Los Gatos, CA (US); Richard E. Hoff, Carlsbad, CA (US); Allan M. Stein, San Diego, CA (US)

(73) Assignee: Geometrix Golf, Encinitas, CA (US)

( * ) Notice: Subject to any disclaimer, the term of this patent is extended or adjusted under 35 U.S.C. 154(b) by 212 days.

(21) Appl. No.: 11/020,071

(22) Filed: Dec. 21, 2004

Related U.S. Application Data

(60) Provisional application No. 60/532,813, filed on Dec. 29, 2003.

(51) Int. Cl.
*A63B 69/36* (2006.01)

(52) U.S. Cl. ..... 473/238; 473/249; 473/250; 473/240; 473/253; 473/254

(58) Field of Classification Search ..... 473/253, 473/254, 240, 241, 238, 249, 250, 251, 252, 473/231; 33/334; D21/742–746, 751; 273/DIG. 14
See application file for complete search history.

(56) References Cited

U.S. PATENT DOCUMENTS 3,548,504 A * 12/1970 Sykes ..... 33/286
3,909,004 A * 9/1975 Vella ..... 473/241
4,032,156 A * 6/1977 Clarke ..... 473/253
4,136,877 A * 1/1979 Antonious ..... 473/254
4,340,229 A * 7/1982 Stuff, Jr. ..... 473/240
4,423,874 A * 1/1984 Stuff, Jr. ..... 473/338
4,458,900 A * 7/1984 Antonious ..... 473/254
4,530,505 A * 7/1985 Stuff ..... 473/250
4,824,114 A * 4/1989 Catalano ..... 473/251
4,902,014 A * 2/1990 Bontomase et al. ..... 473/241
4,928,971 A * 5/1990 Soles, Jr. ..... 473/249
5,409,228 A * 4/1995 Botsch ..... 473/249
6,261,190 B1 * 7/2001 Ashcraft ..... 473/251
2006/0068928 A1 * 3/2006 Nagy ..... 473/238

* cited by examiner

*Primary Examiner*—Sebastiano Passaniti
(74) *Attorney, Agent, or Firm*—Palomar Patent; Calif Tervo; Mary Jo Redman

(57) ABSTRACT

A golf club head includes a transparent cylinder with a sight on top and target on the bottom for indicating to the golfer when the club head is level and on line. An exemplary sight includes a centered disk surrounded by concentric rings; some rings being transparent. The target includes a larger central disk sounded by concentric rings of contrasting color or pattern. At the preferred club orientation, the center of the sight is vertically aligned with the center of the target and the vertical sight picture includes at least four concentric colored or patterned rings. In a second embodiment, the sight and target each include a swing stripe in the swing direction. The relative location of the sight and target centers and swing stripes show the golfer the position of the club head relative to the ball and aid in swing smoothness.

10 Claims, 2 Drawing Sheets

GOLF CLUB HEAD INCLUDING ALIGNMENT DEVICE

CROSS-REFERENCE TO RELATED APPLICATIONS

This application claims the benefit of U.S. Provisional Application No. 60/532,813 titled "An Alignment Device to Assure Proper Alignment of a Golf Club Parallel to the Ground and Square to the Ball Prior to Striking the Ball" filed Dec. 29, 2003.

FIELD OF THE INVENTION

This invention relates in general to alignment devices for golf club heads and more particularly to a sighting device providing superior feedback to a golfer.

BACKGROUND OF THE INVENTION

A golfer must consider several important factors in making a putt. First, the golfer must take care to strike the ball with the club face at the center of percussion for the head; otherwise, force vectors may be imparted at a direction other then in the preferred path of the ball. Second, the golfer must maintain the club face at the desired vertical angle to control ball speed. Third, the golfer must also be able to accurately align the club face at right angles to the preferred path of the ball and swing with the face in this orientation.

There have been a number of designs of putter heads which have attempted to solve some of these problems, but none have been successful in the market place. Some are not easily implemented and none known which assist the golfer in overcoming all of the above mentioned problems.

Therefore, there has been a need for a golf club head that provides improved feedback to the golfer as to club face orientation.

SUMMARY OF THE INVENTION

The invention is golf club head, such as a putter head, including an alignment device for indicating to the golfer when the club head is level. Immediate, clear, simple, reliable feedback is provided the golfer to correct club misalignment. The club head includes a ball striking face having a predetermined ball-striking location thereon for striking a ball and defines a plane having a predetermined preferred vertical orientation. The alignment device includes a sight vertically disposed above a target. In a preferred embodiment, the target is on the top and the sight is on the bottom of a transparent cylinder, such as a plastic cylinder.

An exemplary sight includes a centered disk surrounded by concentric rings; some rings being transparent. The target includes a larger central disk sounded by concentric rings of contrasting color or pattern. The alignment device is attached to the club head such that, when the striking face is at the preferred vertical orientation, the center of the sight is vertically aligned with the center of the target such that the resulting vertical sight picture includes at least four concentric colored or patterned rings; each ring having a uniform width.

In a second exemplary embodiment, the sight has a means, such as a center disk or crossed stripes defining a center. Sight and target each include a swing stripe in the swing direction. The relative location of the centers and swing stripes show the golfer the position of the club head relative to the ball and aid in swing smoothness.

Other features and many attendant advantages of the invention will become more apparent upon a reading of the following detailed description together with the drawings wherein like reference numerals refer to like parts throughout.

DETAILED DESCRIPTION OF THE INVENTION

Figure 1:
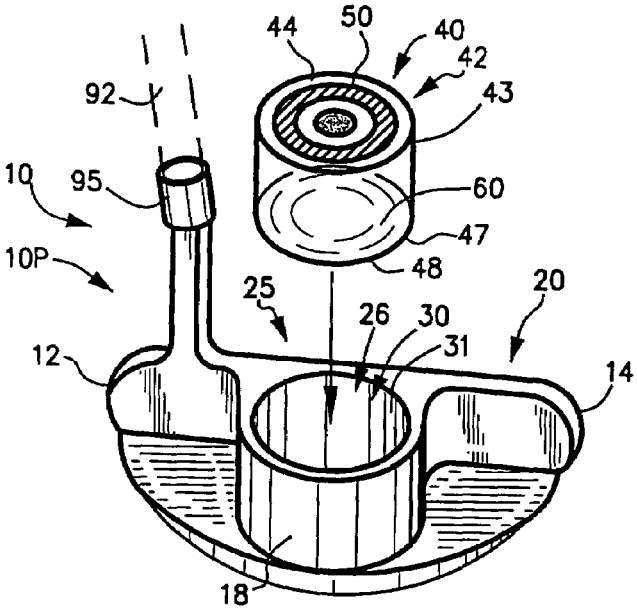
FIG. 1 is an exploded top, rear perspective view of a preferred embodiment of a golf club head in the form of a putter and alignment device according to the invention.
Figure 2:
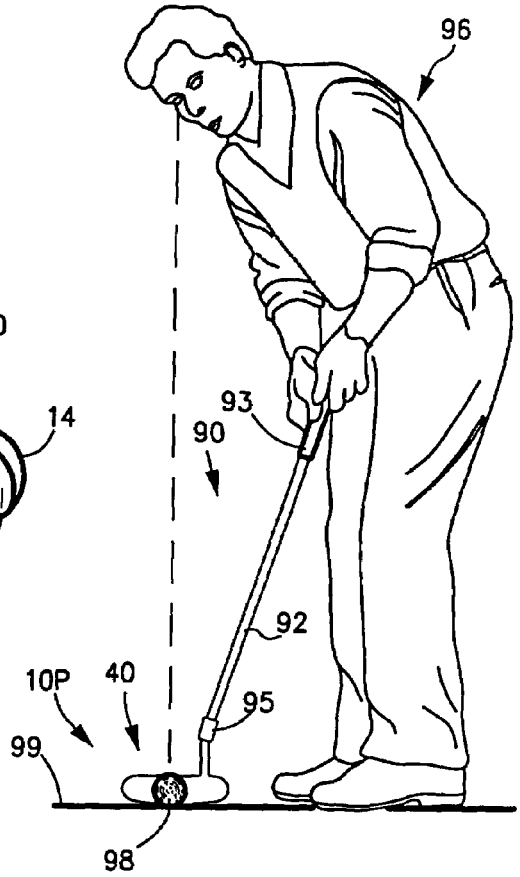
FIG. 2 is a front perspective view of the embodiment of FIG. 1 in use by a golfer.
Figure 3:
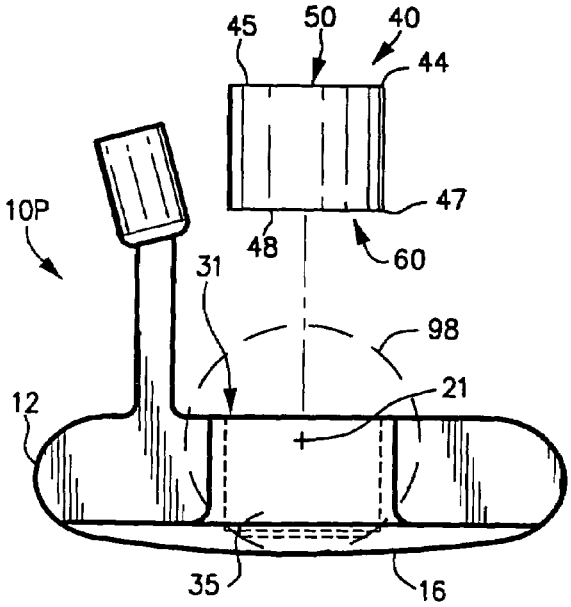
FIG. 3 is an exploded back elevation view of the exemplary putter and alignment device of FIG. 1.
Figure 4:
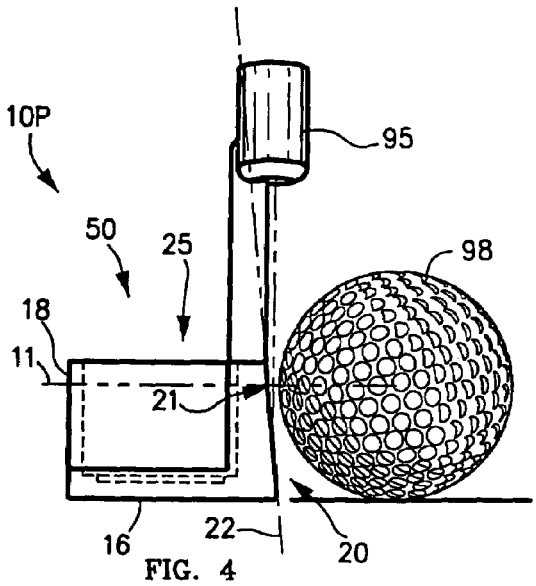
FIG. 4 is a toe end elevation view of the putter of FIG. 1.

With reference now to the drawings and more particularly first to FIGS. 1–4 thereof, there is shown in FIG. 1 an exploded top, rear perspective view of a preferred embodiment of a golf club head 10 in the form of a putter head 10P including an alignment device 42 according to the invention. FIG. 2 is a front perspective view of the embodiment of FIG. 1 in use by a golfer 96. FIG. 3 is an exploded back elevation view of the exemplary putter head 10P and alignment device 42 of FIG. 1. FIG. 4 is a toe end elevation view of the putter head 10P of FIG. 1.

Putter head 10P has a heel 12, a toe 14, a bottom 16, a back 18, a top 25, and face 20. Face 20 for striking a ball 98 has a predetermined ball-striking location 21 thereon for striking ball 98. Face 20 defines a plane 22 having a predetermined preferred vertical orientation for striking ball 98. A face angle of 3.00 to 4.25 degrees back from vertical is preferred. Head 10P, with face 20 in the preferred vertical orientation, has a defined horizontal plane 11 that is parallel to ground 99. Back 18 is opposite face 20 such that the front-back direction defines the swing direction of head 10P. Head 10P includes a vertical plane, not shown, normal to face plane 22. Indicia, such as a marked groove 26, is located in top 25 of head 10P directly above ball striking location 21 so as to be visible to golfer 96.

Putter head 10P is attached, such as by hosel 95, to the lower end of a shaft 92 to form a club 90. The upper end of shaft 92 includes a gripping surface 93 for gripping by golfer 96.

Head 10P includes alignment means 40 for indicating to golfer 96 if face 20 is at the preferred vertical orientation to ball 98 for striking ball 98. In the exemplary embodiment, alignment means 40 generally includes an alignment device 42, such as a rod or cylinder 43, and mounting means 30 for cylinder 43, such as vertical cylindrical cavity 30 in head 10P, for attaching device 42 to head 10P.

Cylinder 43 is made of plastic, glass or similar material so as to be transparent from top 44 to bottom 47. Top 44 of cylinder 43 includes a flat face 45 having a sight 50 thereon. Bottom 47 of cylinder 43 includes a flat face 48 having a target 60 thereon. Although in the exemplary embodiment, alignment device 42 is a solid cylinder 43, it should be understood that it may be any means for holding a sight 50 and a target 70 in vertical spaced relationship with a transparent medium therebetween. A target diameter in the range of 1.25 to 1.5 inches has been found to be large enough to convey the desired information. Smaller targets are difficult to read.

Cavity 31 is formed in head 10P for receiving cylinder 43 such that top face 45 and bottom face 48 are parallel to horizontal plane 11. Alternately, of course, target 70, instead of being disposed on bottom 47 of cylinder 43, could be placed in bottom 35 of cavity 31 before insertion of cylinder 43. In which case, bottom 35 of cavity 31 is parallel with horizontal plane 11. Preferably, cavity 31 is centered directly behind ball-striking location 21.

Figure 5:
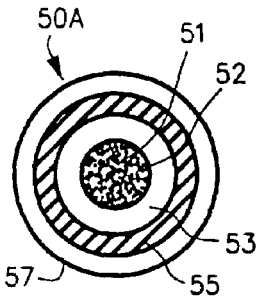
FIG. 5 is a top plan view of an exemplary sight of the alignment device.
Figure 6:
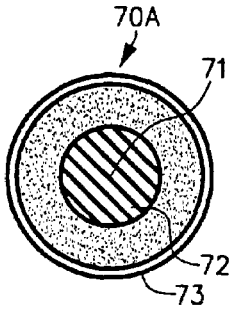
FIG. 6 is a top plan view of an exemplary target for the sight of FIG. 5.

Adding FIGS. 5 and 6, FIG. 5 is a top plan view of an exemplary sight 50A of alignment device 42 and FIG. 6 is a top plan view of an exemplary target 70A for sight 50A of FIG. 5

Sight 50A is symmetrical about a center 51 and includes a first centered figure, such as disk 52, and a spaced concentric ring 55; the areas between disk 52 and ring 55 and outside ring 56 being transparent. Alternately, sight can be described as having a first centered disk 52, having a perimeter and a color or pattern, a first concentric ring 53 surrounding disk 52 and being transparent, a second concentric ring 55 having a pattern or color and an inside perimeter radially outwardly spaced from the perimeter of disk 52 and an outside perimeter, and a third concentric ring 57 surrounding second concentric ring 55 and being transparent. Although disk 52 is shown, first centered figure could be another shape, such as a ring, triangle, or square, for example.

Target 70 is symmetrical about a center 71 and includes a second centered figure, such as disk 72, having a shape similar to the first centered figure and having a perimeter larger than the perimeter of the first centered figure, such as of first disk 52, and distinguishable in color or pattern the first centered figure, such as from first disk 52, and a fourth concentric ring 73 having an inside perimeter smaller than said inside perimeter of second concentric ring 55 and an outside perimeter larger than the outside perimeter of second concentric ring 55 and distinguishable in color or pattern from second concentric ring 55.

Typically, centered disk 52 is black and second disk 72 is a white or other light color, such as fluorescent yellow. The other rings are contrasting colors and/or patterns.

Figure 7:
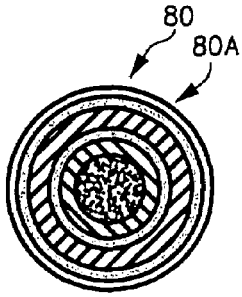
FIG. 7 is a top plan view of the sight picture of the sight of FIG. 5 vertically aligned with the target of FIG. 6.

FIG. 7 is a top plan view of a sight picture 80. A sight picture 80 is what is seen when looking at target 70 through sight 50. Sight picture 80, such as aligned sight picture 80A, is of sight 50A of FIG. 5 vertically aligned with target 70A of FIG. 6. Sight picture 80A is the visual picture golfer 96 of FIG. 2 would see when looking vertically down at alignment device 42 in head 10P with striking face 20 in the preferred vertical orientation. It is seen that sight picture 80A provides multiple feed back signifying proper alignment. There is a central disk and five surrounding concentric rings.

Figure 8:
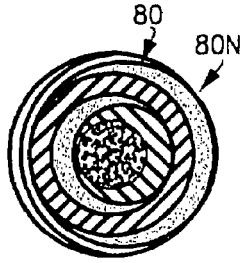
FIG. 8 is a view of the sight picture of the sight of FIG. 5 not vertically aligned with the target of FIG. 6.

FIG. 8 is a view of sight picture 80, such as non-aligned sight picture 80N, of sight 50A of FIG. 5 not vertically aligned with target 70A of FIG. 6. This is an example of a sight picture 80 with golfer 96 looking downward with striking face 20 not aligned to strike ball 98. It is very easily seen from non-aligned sight picture 80N from the multiple non-symmetries that adjustment must be made. In this example, it is obvious the head 10P is not level as target 50A is too far forward (left). To correct this, golfer 96 must alter the angle of shaft 92, either by altering the position of his hands or by altering his stance such that the top of shaft 72 moves rearward (right) to level head 10P. Thus, sight 50A and target 70A provide excellent feedback to golfer 96 to adjust position of head 10P.

Figure 9:
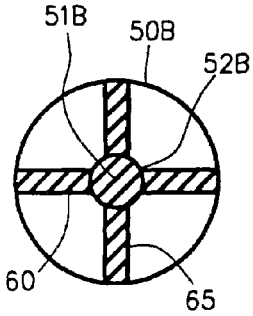
FIG. 9 is a top plan view of an alternate exemplary sight of the alignment device.
Figure 10:
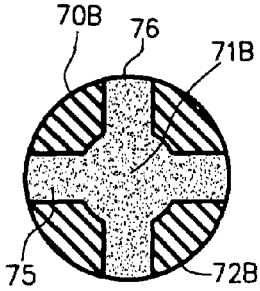
FIG. 10 is a top plan view of an exemplary target for the sight of FIG. 9.

FIGS. 9 and 10 illustrate an alternate embodiment of sight 50B and target 70B intended to more specifically aid in fine alignment of the swing of head 10P. FIG. 9 is a top plan view of alternate exemplary sight 50B of alignment device 42. FIG. 10 is a top plan view of an exemplary target 70B for sight 50B of FIG. 9.

Sight 50B includes means, such as first disk 51B or crossed stripes, such as swing stripe 60 and lateral stripe 65, to define a center 51B. First centered disk 52B has a perimeter and a color or pattern. Swing stripe 60 has a length in a front-back direction and a width in the lateral direction. Preferably, swing stripe 60 or a projection thereof passes through center 51B. Lateral stripe 65 is orthogonal to first stripe 60 and has a length in heel-toe direction and a width. Preferably, lateral stripe 65, or a projection thereof, passes through center 51B. The remainder of the area of sight 50*b* may be clear, that is transparent.

Target 70B has a center 71B and includes a second centered disk 72B having a perimeter larger than the perimeter of first disk 52B and distinguishable in color or pattern therefrom, a swing stripe 75 and a lateral stripe 76. Swing stripe 75 has a length in a front-back direction in the vertical plane normal to face 20 and a lateral width wider than the width of swing stripe 60 and distinguishable in color or pattern therefrom. Lateral stripe 76 is orthogonal to swing stripe 75 and has a length in the heel-toe direction and a width. Preferably, lateral stripe 76, or a projection thereof, passes through center 71B.

Figure 11:
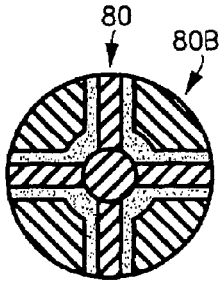
FIG. 11 is a top plan view of the sight picture of the sight of FIG. 9 vertically aligned with the target of FIG. 10.
Figure 12:
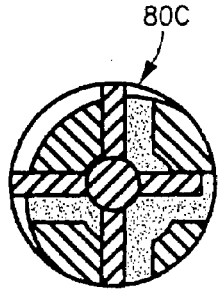
FIG. 12 is a view of the sight picture of the sight of FIG. 9 not vertically aligned with the target of FIG. 10.
Figure 13:
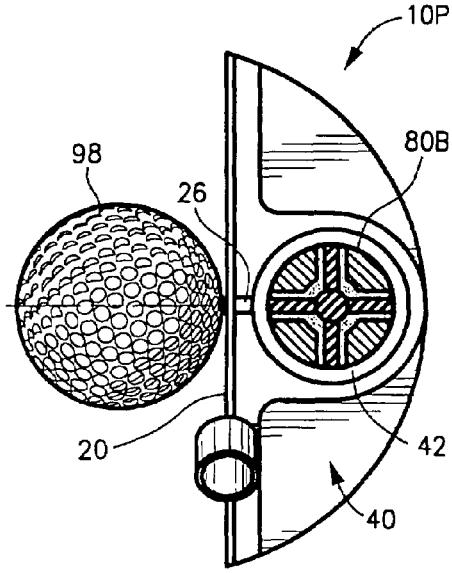
FIG. 13 is a top plan view of the putter head of FIG. 1 including the sight and target of FIGS. 9 and 10 and in proper striking position for a ball.
Figure 14:
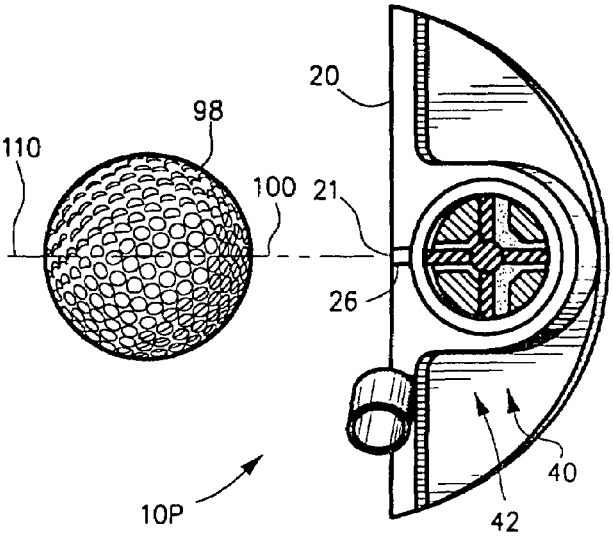
FIG. 14 is a top view of the putter head of FIG. 13 showing the putter in proper swinging alignment for striking the ball.

FIG. 11 is a top plan view of the sight picture 80, such as sight picture 80B, of sight 50B of FIG. 9 vertically aligned with target 70B of FIG. 10. FIG. 12 is a view of sight picture 80C of sight 50B of FIG. 9 not vertically aligned with target 70B of FIG. 10. From FIG. 12 it is seen that head 10P in not aligned laterally or in the swing direction in that the center 51B of target 50B is to the left and away. This visual feedback makes it quickly seen that golfer 96 must alter the angle of the shaft 92 toward him and rearward by changing stance or hand position or both. FIG. 13 is a top plan view of putter head 10P of FIG. 1 with sight 50B and target 70B of FIGS. 9 and 10 aligned such that the resulting vertical sight picture 80B includes first disk 52B surrounded by a halo of said second disk 72B and includes swing stripe 60 having equal width lateral borders of swing stripe 75. Head 10P is in proper striking position for ball 98. FIG. 14 is a top view of putter head 10P of FIG. 13 showing putter head 10P in proper swinging alignment for striking ball 98 in that swing stripe 60 has equal width lateral borders of swing stripe 75. The swing line 100 of head 10P is proper, that is it is co-linear with the preferred path of movement 110 of ball 98.

It is seen from FIG. 14 that alternate sight 50B and target 70B provide additional feedback to golfer 96 regarding the direction of swing. Should head 10P move laterally out of alignment with the proper swing line 100, then the visible borders of target swing stripe 75 will differ in width.

Although a particular embodiment of the invention has been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

We claim:

1. A golf club head comprising:

a ball striking face having a predetermined ball-striking location thereon for striking a ball; said face defining a plane having a predetermined preferred vertical orientation and; a bottom;

a top;

alignment means comprising:

an alignment device comprising:

a sight having a center and comprising a first centered figure having a perimeter and a color or pattern;

a first concentric ring surrounding said first centered figure; said first concentric ring being transparent;

a second concentric ring having a pattern or color and an inside perimeter radially outwardly spaced from the perimeter of said first centered figure and an outside perimeter; and a third concentric ring surrounding said second concentric ring; said third concentric ring being transparent; and a target disposed below said sight and separated therefrom by a transparent medium; said target having a center and comprising:

a second centered figure having a perimeter larger than the perimeter of said first centered figure and distinguishable in color or pattern from said first centered figure; and a fourth concentric ring having an inside perimeter smaller than said inside perimeter of said second concentric ring and an outside perimeter larger than said outside perimeter of said second concentric ring and distinguishable in color or pattern from said second concentric ring; and attaching means for attaching said alignment device to said head such that said striking face is at the preferred vertical orientation when the center of said sight is vertically aligned with the center of said target such that the resulting vertical sight picture includes at least four concentric colored or patterned rings.

2. The golf club head of claim 1 wherein:

said alignment means includes:

a rod having a top and a bottom wherein said sight is disposed on said top of said rod.

3. The golf club head of claim 2 wherein:

said attachment means includes:

a cavity in said top of said head for receiving said rod.

4. A golf club head comprising:

a ball striking face having a predetermined ball-striking location thereon for striking a ball; said face defining a plane having a predetermined preferred vertical orientation for striking a ball; said head having a horizontal plane with said face in the preferred vertical orientation;

a heel;

a toe; the heel-toe direction defining the lateral direction;

a bottom;

a top; and a back opposite said face; the front-back direction defining the swing direction; and alignment means comprising:

an alignment device comprising:

a sight including:

a center indicator; and a swing stripe having a length in the swing direction and having a lateral width and a target disposed vertically below said sight and separated therefrom by a transparent medium; said target including:

a center indicator; and a swing stripe having a length in the swing direction and having a lateral width wider than the width of said swing stripe of said sight and distinguishable in color or pattern from said swing stripe of said sight; and attachment means for attaching said alignment device to said head such that said striking face is at the preferred vertical orientation when the center of said sight is vertically aligned with the center of said target such that the resulting vertical sight picture includes said swing stripe of said sight being laterally bordered by equal widths of said swing stripe of said target.

5. The golf club head of claim 4 wherein:

said sight includes a lateral stripe orthogonal to said swing stripe of said sight; said lateral stripe of said sight having a length in the lateral direction and a width; and said target includes a lateral stripe orthogonal to said swing stripe of said target; said lateral stripe of said target having a length in the lateral direction and a width.

6. The golf club head of claim 5 wherein:

said lateral stripe of said sight or a projection thereof crosses said swing stripe of said sight at the center of said sight; and said lateral stripe of said target or a projection crosses said swing stripe of said target at the center of said target.

7. A golf club head comprising:

a ball striking face having a predetermined ball-striking location thereon for striking a ball; said face defining a plane having a predetermined preferred vertical orientation for striking a ball; said head having a horizontal plane with said face in the preferred vertical orientation;

a heel;

a toe; the heel-toe direction defining the lateral direction;

a bottom;

a top; and a back opposite said face; the front-back direction defining the swing direction; and alignment means comprising:

an alignment device comprising:

a sight having a center and comprising a first centered figure having a perimeter and a color or pattern;

a swing stripe having a length in the swing direction and having a lateral width and a target disposed vertically below said sight and separated therefrom by a transparent medium; said target having a center and comprising:

a second centered figure having a perimeter larger than the perimeter of said first centered figure and distinguishable in color or pattern from said first centered figure; and a swing stripe having a length in the swing direction and having a lateral width wider than the width of said swing stripe of said sight and distinguishable in color or pattern from said swing stripe of said sight; and attachment means for attaching said alignment device to said head such that said striking face is at the preferred vertical orientation when the center of said sight is vertically aligned with the center of said target such that the resulting vertical sight picture includes said first centered figure surrounded by a ring of said second centered figure and includes said swing stripe of said sight being laterally bordered by equal widths of said swing stripe of said target.

8. The golf club head of claim 7 wherein:

said alignment means includes:

a rod having a top and a bottom wherein said sight is disposed on said top of said rod.

9. The golf club head of claim 7 wherein:

said attachment means includes:

a cavity in said top of said head for receiving said rod.

10. The golf club head of claim 7 wherein:

said sight includes a lateral stripe orthogonal to said swing stripe of said sight; said lateral stripe of said sight having a length in the lateral direction and a width; and said target includes a lateral stripe orthogonal to said swing stripe of said target; said lateral stripe of said target having a length in the lateral direction and a width.

* * * * *